United States Patent [19]

LeMaster

[11] Patent Number: 4,813,786

[45] Date of Patent: Mar. 21, 1989

[54] FLUID MIXING UNIT

[75] Inventor: David A. LeMaster, Garfield Heights, Ohio

[73] Assignee: Ohio Tool Systems, Inc., Richfield, Ohio

[21] Appl. No.: 26,966

[22] Filed: Mar. 17, 1987

[51] Int. Cl.[4] ..... B01F 7/22

[52] U.S. Cl. ..... 366/251; 366/279; 366/282; 366/349

[58] Field of Search ..... 366/241, 244, 245, 247, 366/249, 251, 279, 281, 282, 283, 284, 349; 285/361, 376, 402, 84

[56] References Cited

U.S. PATENT DOCUMENTS

| | | | |
|---|---|---|---|
| 1,051,805 | 1/1913 | Danberg | 285/376 |
| 1,449,051 | 3/1923 | Mitchell | 366/282 |
| 2,565,770 | 8/1951 | Johnson | 366/279 |
| 2,684,860 | 7/1954 | Rofferty | 285/376 |
| 2,911,240 | 11/1959 | Boutres et al. | 366/282 |
| 2,991,940 | 7/1961 | Dupler et al. | 285/376 |
| 3,111,954 | 11/1963 | Duncan | 366/349 |
| 3,297,309 | 1/1967 | Adams | 366/282 |
| 4,050,580 | 9/1977 | Wilson | 206/511 |
| 4,185,856 | 1/1980 | McCasuill | 285/376 |
| 4,197,072 | 4/1980 | Harten | 425/144 |
| 4,422,770 | 12/1983 | Geible | 366/279 |
| 4,525,610 | 6/1985 | Le Magovrou | 200/51.09 |

FOREIGN PATENT DOCUMENTS

| | | | |
|---|---|---|---|
| 1238369 | 7/1960 | France | 285/376 |
| 90052 | 5/1985 | Japan | 366/279 |

*Primary Examiner*—Harvey C. Hornsby
*Assistant Examiner*—Joseph S. Machuga
*Attorney, Agent, or Firm*—Renner, Kenner, Greive, Bobak, Taylor & Weber

[57] ABSTRACT

A fluid mixing unit (10) for agitating, mixing and/or blending fluids (41) held in a container (11). The mixing unit (10) has an impeller module (12) that may be relatively permanently affixed to the container (11). An impeller shaft (24) is rotatably mounted in the impeller module (12) to rotate an impeller (37) secured to the shaft (24) and disposed interiorly of the container (11). The mixing unit (10) also includes a power module (14) that may be demountably secured to the impeller module (12) by virtue of a fast make/break connector (15). The first component (55) of the make/break connector (15) is presented from the impeller module (12), and the second component (79) thereof is presented from the power module (14). A quick connect coupling (48) effects a driving connection between the power module (14) and the impeller shaft (24). A locking means (85) may be employed to prevent at least inadvertent disengagement of said fast make/break connector (15).

3 Claims, 3 Drawing Sheets

FLUID MIXING UNIT

TECHNICAL FIELD

The present invention relates generally to fluid mixing units. More particularly, the present invention relates to apparatus employed in conjunction with generally portable containers for agitating, mixing and/or blending of fluids held therein—including the dispersion of particulate matter in order to effect suspension of the particulate matter within the fluid. Specifically, the present invention relates to fluid mixing units wherein an impeller module can be relatively permanently affixed to a container for fluids and wherein a fast make/break connector is employed selectively to couple an independent power module to a sequential plurality of impeller modules.

BACKGROUND OF THE INVENTION

Fluids are often transported, stored, mixed and/or discharged from commercial tanks, bins or other portable containers. It is often desirable, if not mandatory, that the fluids held in such containers be agitated, mixed or blended on one or more occasions between the time they are loaded into the containers and the time they are discharged therefrom. In order to effect the desired mixing, one was historically required to open the container and insert a mixing unit. There were, however, several drawbacks to such an approach.

First, of course, if a plurality of containers were stored in close proximity, it was often difficult to gain access to the selected container in the manner required not only to remove the lid, or open the port provided, but also to insert the mixing unit. But even if the lid, or the port, was readily accessible, it was sometimes difficult to remove the lid, or open the port, particularly if the material in the container was highly volatile and the openings had been sealed to retain the vapors.

Moreover, the diameter of the access opening through which the mixing unit was required to be inserted had to be of sufficient diameter to permit the insertion of the impeller blades therethrough. In addition, if the container was substantially full, the mixing unit had to be operated with considerable care so as not to splash, or otherwise spill, the contents. This often required operating the mixing unit at those speeds, and at those power settings, which were simply not efficient for the degree to which the contents of the container should be agitated, mixed or blended.

Even in those situations where the necessary mixing could be accomplished at the speed, and power, permitted, the mixing unit had to be withdrawn and the container closed after the mixing operation was concluded. The complexity of the closing operation was compounded if the container had to be sealed to preclude either the loss of vapors or the continuous introduction of outside air.

It should also be remembered that the mixing unit would have to be completely cleaned after each usage in order to avoid contamination of the contents in the next container with which the mixing unit was to be used.

Finally, even if one were able to adapt to the aforesaid drawbacks, there is the irrefutable fact that it simply takes an inordinate amount of time to open, mix, close and seal each container let alone clean the mixing unit after each use. When one considers today's labor costs such an expenditure of time incurs a considerable increase in the cost of shipping and storing fluids which require agitation, or the like, at repeated intervals.

SUMMARY OF THE INVENTION

It is, therefore, a primary object of the present invention to provide a mixing unit which facilitates agitating, mixing and/or blending of fluids that are shipped and stored in commercial containers, and particularly if such agitation, or the like, is required, or desired, to be repeated at intervals.

It is another object of the present invention to provide a mixing unit, as above, which permits an impeller module to be quite easily, and relatively permanently, affixed to the container and at the same time to be readily accessible for operation by a power module that can be demountably secured to a selective sequence of such impeller modules by virtue of a fast make/break connector.

It is yet another object of the present invention to provide a mixing unit, as above, that allows the power module to be demountably secured to the impeller module without requiring anyone to insert their hand(s) into an area where injury could result and also without requiring the use of any tools.

It is a further object of the present invention to provide a mixing unit, as above, that can employ a locking means by which to preclude inadvertent disengagement of the fast make/break connector.

It is a still further object of the present invention to provide a mixing unit, as above, wherein the impeller unit, when affixed to a container, presents such a low profile that its presence on the container does not normally interfere with stacking of the containers.

These and other objects of the invention, as well as the advantages thereof over existing and prior art forms, which will be apparent in view of the following detailed specification, are accomplished by means hereinafter described and claimed.

In general, a mixing unit embodying the concepts of the present invention is adapted for use in conjunction with commercial tanks, bins or other portable containers of the type employed to transport, store, mix and/or discharge fluids.

An impeller module may be relatively permanently affixed to such a container. The impeller module includes a bearing housing, and an impeller shaft is rotatably mounted within the bearing housing. One or more impellers are secured to the shaft and disposed interiorly of the container for rotation with the shaft. A first component of a fast make/break connector is presented from the impeller module.

A power module is demountably secured to the impeller module by virtue of a fast make/break connector. The power module includes a power source that is secured to a mounting frame. A coupler is presented from the power source for operative engagement with the impeller shaft, and a second, or mating, component of the fast make/break connector is presented from the power module for selective engagement with the first component of the fast make/break connector presented from the impeller module.

A locking means is preferably employed to prevent inadvertent disengagement of the two components which comprise the fast make/break connector.

A fluid mixing unit embodying the concepts of the present invention is shown by way of example in the accompanying drawings and described in detail without attempting to show all of the various forms and modifications in which the invention might be embodied; the invention being measured by the appended claims and not by the details of the specification.

DESCRIPTION OF AN EXEMPLARY EMBODIMENT

Figure 1:
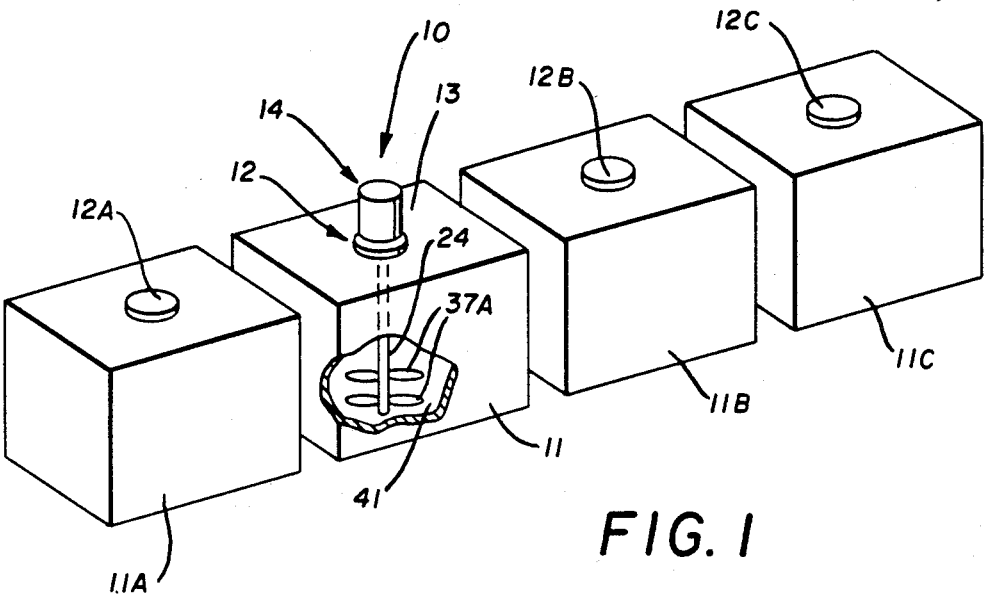
FIG. 1 is a perspective view of a plurality of containers with which a fluid mixing unit embodying the concepts of the present invention is employed, three of said four containers being depicted with only an impeller module relatively permanently affixed thereto and the fourth of said containers being depicted not only with a power module operatively connected to the impeller module but also with that container being partially broken away to reveal the impeller blades mounted on the impeller shaft.

A fluid mixing unit is designated generally by the numeral 10 on the accompanying drawings. As represented in FIG. 1, the mixing unit 10 is depicted in conjunction with a commercial container 11 of the type employed to transport, store, mix and discharge fluids. The mixing unit 10 employs an impeller module 12 that may be rather easily affixed to the lid 13 of the container, or tank, 11 in a manner that is relatively permanent. A power module 14 is demountably secured to the impeller module 12 by virtue of a fast make/break connector 15 (best depicted in FIGS. 2 and 5).

The impeller module 12 may not only be attached to the lid 13 with comparative ease, but, if and when desired, the impeller module 12 may also be detached from the lid 13 with comparative ease. As will become apparent, it is generally preferred that the impeller module 12 be securely affixed to the lid 13 of the container 11 for relatively long periods. Accordingly, the connection of the impeller module 12 to the lid 13 is termed to be "relatively permanent." The power module 14, on the other hand, is preferably connected to the impeller module 12 only when one desires to operate the mixing unit 10 for a particular container 11 to which an impeller module 12 is affixed. Thus, the fast make/break connector 15 provides the user with an effective and convenient means by which operatively to mount and demount an independent power module 14 with respect not only to the impeller module 12 that is relatively permanently affixed to container 11 but also to the selective impeller modules 12A through 12C mounted on one of a plurality of the corresponding containers 11A through 11C.

Figure 2:
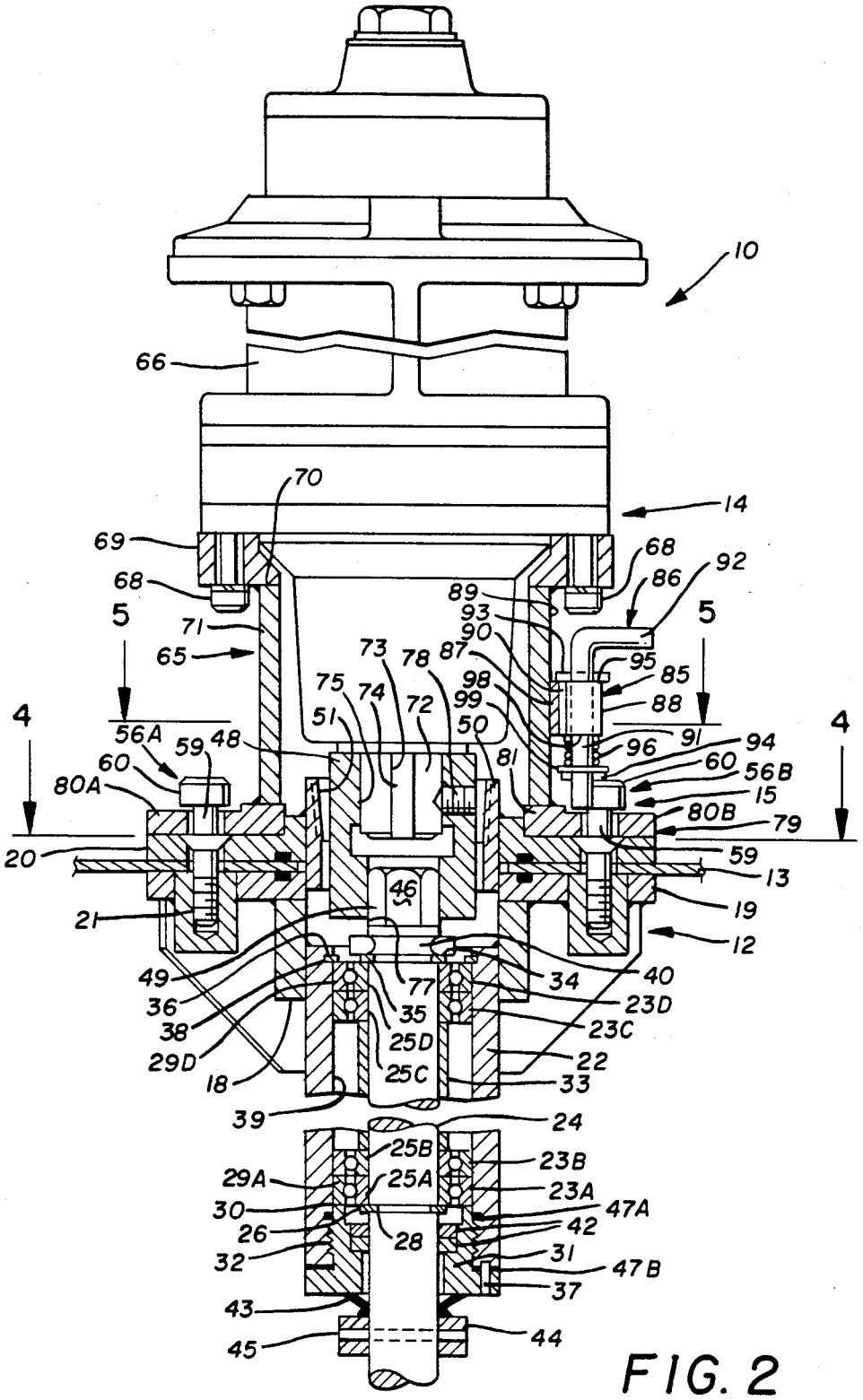
FIG. 2 is a vertical section through a portion of the mixing unit depicted in conjunction with the fourth container in FIG. 1, said vertical section detailing the impeller and power modules as well as the fast make/-break connector by which the modules may be selectively joined.
Figure 4:
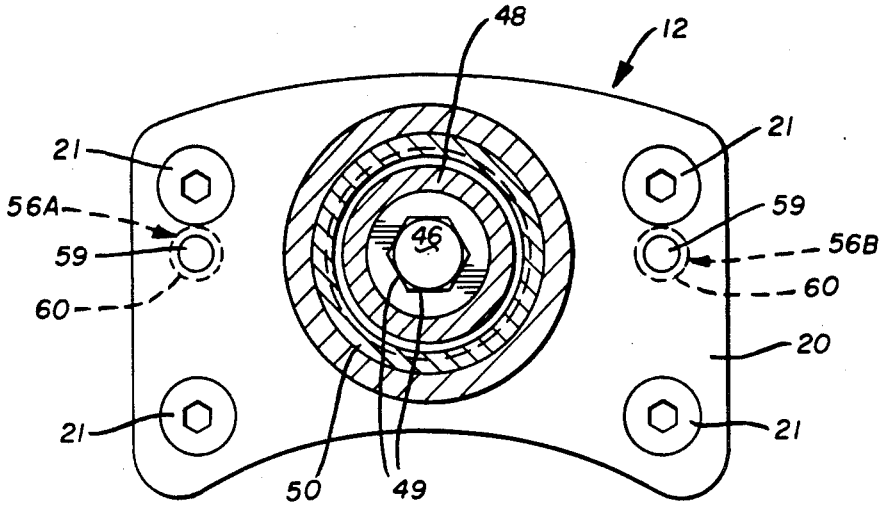
FIG. 4 is a transverse section taken substantially along line 4—4 of FIG. 2 and depicting the anchor plate of the impeller module in top plan; and, FIG. 5 is also a transverse section, but taken substantially along line 5—5 of FIG. 2 and depicting not only the interengagement of the components forming the fast make/break connector, in top plan, but also the locking means operative therebetween, in cross section.

With particular reference to FIG. 2 it will be seen that the impeller module 12 includes a housing member 18 from which a mounting flange 19 extends transversely to underlie the lid 13. The housing member 18 also includes an anchor plate 20, and the anchor plate 20 overlies the lid 13 to register with the mounting flange 19. A plurality of fasteners, such as the machine screws 21 depicted, are employed to secure the anchor plate 20 to the mounting flange 19 and thus firmly sandwich the lid 13 therebetween.

The housing member 18 also includes a barrel portion 22 that extends downwardly relative to the mounting flange 19 to retain the bearings 23 in which the impeller shaft 24 rotates. To impart both lateral and axial stability to the shaft 24, one may employ axially spaced bearings such as, for example, the pair 23A and 23B which are spaced axially along the shaft 24 from pair 23C and 23D. The axially lower edge on the inner race 25A of the lowermost bearing 23A is engaged by a retaining ring 26 received within an annular groove 28 which circumscribes the shaft 24, and the axially lower edge on the outer race 29A of the lowermost bearing 23A is engaged by an annular lip 30 on the end cap 31. As depicted, the end cap 31 may be detachably secured to the barrel portion 22, as by thread means 32. A locking pin 37, which may conveniently be in the nature of a pull dowel or a roll pin, extends through the end cap 31 and into the barrel portion 22 in order to preclude the end cap 31 from being inadvertently unscrewed from the barrel portion 22.

The second bearing 23B is disposed in contiguous juxtaposition with the upper side of the lowermost bearing 23A. The inner race 25B of the bearing 23B engages an annular sleeve 33 that is disposed concentrically about the shaft 24 and which extends axially therealong to define the axial spacing between the pairs of bearings (23A, 23B and 23C, 23D). As such, the lower edge on the inner race 25C of the bearing 23C is also engaged by the sleeve 33.

The uppermost bearing 23D lies in contiguous juxtaposition with the bearing 23C, and the upper edge of the inner race 25D in bearing 23D engages a retaining ring 34 that is received within a second annular groove 35 which also circumscribes the shaft 24. The upper edge of the outer race 29D in bearing 23D similarly engages a retaining ring 36 that is received within an annular groove 38 in the interior surface 39 of the barrel portion 22.

Rather than require the retaining ring 34 to resist the full effect of the axially downwardly directed forces that may be imposed upon the shaft 24, the shaft 24 may be transversely bored to receive a thrust pin 40. The thrust pin 40 lies adjacent the retaining ring 36 and thus is opposed—through the axially stacked ring 36, the four bearings 23A–23D and the sleeve 33—by the lip 30 on the end cap 31.

One or more blade-like impellers 37A (FIG. 1) may be selected from the wide variety of impellers known to the art for effecting the desired agitating, mixing or blending of the fluid 41 held in a container 11 and secured to the shaft 24 interiorly of fluid 41 for rotation with the shaft 24.

With reference again to FIG. 2, the necessary seals 42 are interposed between the end cap 31 and the shaft 24, and the necessary seals 47A and 47B are also interposed between the end cap 31 and the barrel portion 22. The aforesaid seals 42, 47A and 47B are provided to preclude the loss of fluid 41 upwardly past the shaft 24, and conversely, to prevent the incursion of contaminants into the fluid 41 by eliminating access to the interior of the container 11 downwardly along the shaft 24. An additional seal 43 may be interposed between the end cap 31 and a collar 44 that is carried on the shaft 24, as by a securing pin 45 that is received transversely through the shaft 24.

The uppermost end of the shaft 24 terminates in a drive head 46. To facilitate a driving connection between the shaft 24 and a quick connect coupling 48 fastened to the power module 14 the drive head 46 may, as shown, present a hexagonal, or other geometric, exterior surface 49. A guide 50 is also preferably secured to the anchor plate 20. The interior surface 51 of the guide 50 is disposed concentrically of the drive head 46 and may be conically tapered to direct the coupling 48 into the required concentricity with the drive head 46 and thereby assist in effecting engagement between the coupling 48 and the drive head 46 when the power module 14 is being attached to the impeller module 12, as will hereinafter be more fully described.

Figure 3:
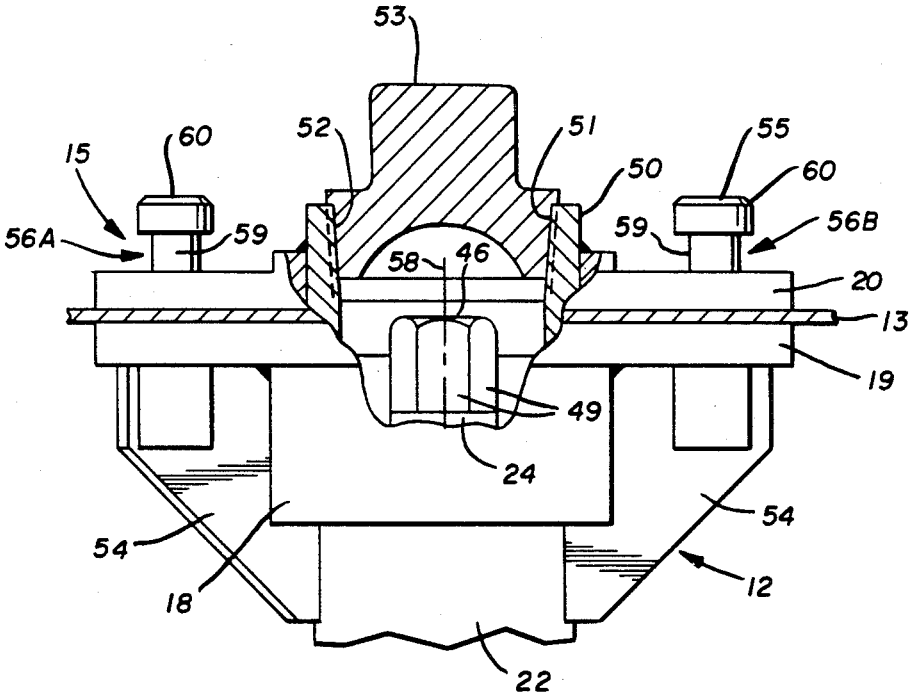
FIG. 3 is a further enlarged, vertical section representing a portion of the impeller module depicted in FIG. 2, but with the power module removed.

Referring more particularly to FIG. 3 it will be seen that the interior surface 51 may also be provided with threads 52 by which a sealing plug 53 may be secured to the impeller module 12 when the drive module 14 is removed.

The configuration of the impeller module 12 heretofore described, as well as the arrangement by which such a module is relatively permanently affixed to a container 11, presents such a relatively low profile that those containers 11 capable of being stacked can, in most instances, still be stacked, even with the impeller module 12 relatively permanently affixed thereto, without damage to the impeller module 12.

FIG. 3 also reveals that the impeller module 12 may be structurally stabilized by employing one or more haunch plates 54 disposed at circumferentially spaced intervals about the housing member 18 and rigidly secured, as by welding, to the mounting flange 19, the housing 18 and the barrel portion 22.

As is also best seen from FIG. 3, the first component 55 of the fast make/break connector 15 is presented from the anchor plate 20 of the impeller module 12. Specifically, a pair of diametrically opposed bayonet lugs 56A and 56B are secured to the anchor plate 20 radially outwardly of the guide 50. The bayonet lugs 56A and 56B extend upwardly from the anchor plate 20 in preferably parallel relation to the axis 58 of the impeller shaft 24. The bayonet lugs 56A and 56B may each be permanently secured to the anchor plate 20, and each bayonet lug 56A and 56B comprises a preferably cylindrical stem portion 59 which terminates—in spaced, vertical relation, upwardly of the anchor plate 20—in a radially expanded head portion 60.

With reference again to FIG. 2, the power module 14 includes an attaching frame 65 to which a power source, such as designated by the numeral 66, may be secured. Virtually any power source may be employed that is capable of providing the necessary torque at the desired speed(s), and that is capable of doing so without introducing potentially dangerous electrical arcing. Shaft speeds ranging from moderately above to moderately below 300 r.p.m. are typically desired, and the necessary torque can generally be provided by the use of fractional horsepower motors, although there is no reason why one could not employ a motor of greater horsepower, if desired or required.

The use of air driven, or arc-proof electrical, motors for the power source 66 will certainly provide satisfactory operation within the aforesaid parameters. As such, the power source 66 may well comprise an electric motor that may be secured, as by a plurality of cap screws 68, to the mounting flange 69 which extends radially outwardly from the upper end 70 of the body portion 71 in the attaching frame 65.

Figure 5:
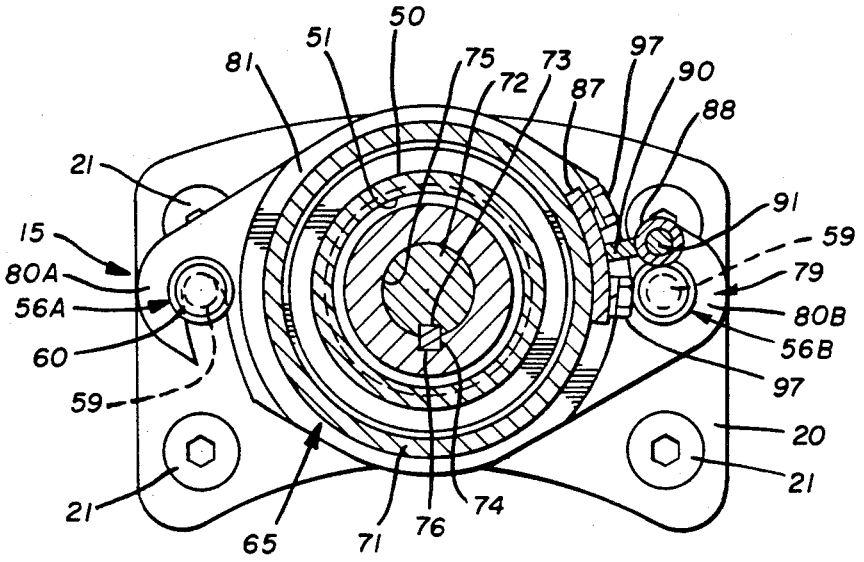

At least the drive shaft 72 of the motor 66 extends interiorly of the attaching frame 65, and the quick connect coupling 48 is affixed to the drive shaft 72. The cylindrical drive shaft 72 may be provided with an axially extending keyway 73 to receive a key 74. As represented in FIG. 5, the interior surface 75 of the coupling 48 is also provided with an axial groove 76 to receive the key 74 so that the key 74 can effect a rotational driving connection between the shaft 72 and the coupling 48. The coupling 48 may be axially secured to the shaft 72 by the set screw 78 depicted. That portion of the coupling 48 which extends below the shaft 72 incorporates a drive socket, the interior surface 77 of which is geometrically configured in order matingly to engage the geometric surface 49 on the rive head 46 of the shaft 24.

The second component 79 of the fast make/break connector 15 is presented from the mounting frame 65. Specifically, a pair of diametrically opposed bayonet hooks 80A and 80B extend radially outwardly from the end plate 81 at the lower extremity of the body portion 71 in the attaching frame 65. The hooks 80A and 80B are configured, and disposed, to engage the stem portions 59 on the corresponding bayonet lugs 56A and 56B, respectively, and to be precluded from axial disengagement from the lugs 56 by virtue of the head portions 60 on each.

To assist in maintaining the connecting engagement between the hooks 80 and the lugs 56, the hooks 80 are preferably disposed such that any rotative movement imparted to the hooks as a result of their reaction to the normal rotational direction of the power source 66 will tend to drive the hooks 80 against the lugs 56.

In addition, a locking means 85 is also preferably employed to obviate inadvertent disengagement of the bayonet hooks 80 from the bayonet lugs 56. As depicted in FIGS. 2 and 5, the locking means 85 employs a latch pin 86 that is received within a sleeve bearing 88 for at least axial translation and preferably also for limited rotation. Specifically, the sleeve bearing 88 may be secured in spaced relation outwardly of the exterior surface 89 on the body portion 71 of the mounting frame 65. The radial placement of the sleeve bearing 88 must be such that the latch pin 86 received therein will normally engage the head portion 60 of one bayonet lug 56, such as lug 56B, when the mounting frame 65 is rotated, as is necessary to engage, or disengage, the bayonet hooks 80 from the bayonet lugs 56.

To achieve the desired interference between the latch pin 86 and the head portion 60 on one of the bayonet lugs 56B, a spacer plate 90 may be interposed between the sleeve bearing 88 and the body portion 71 of the mounting framed 65. One approach is to affix the spacer plate 90 not only to the sleeve bearing 88 but also to a mounting flange 87 that may be secured to the exterior surface 89 on the body portion 71 of the mounting frame 65, as by a pair of machine screws 97 which are depicted in FIG. 5.

The latch pin 86 has a spindle portion 91 and a handle portion 92. The spindle portion 91 is received within the sleeve bearing 88 and retained therein by spaced cross pins 93 and 94 which transversely penetrate the spindle portion 91. The upper cross pin 93 engages the upwardly directed end surface 95 of the sleeve bearing 88 to limit the axially downward movement of the spindle portion 91 induced by the biasing action of the spring 96 which acts between the downwardly directed end surface 98 of the sleeve bearing 88 and the washer 99 which is retained on the spindle portion 91 by the lower cross pin 94.

Thus, in order to engage, or disengage, the fast make/break connection 15 it is imperative that the spindle portion 91 of the latch pin 86 be raised against the biasing action of the spring 96. To so raise the spindle portion 91 one engages the handle portion 92 and applies the necessary pressure to effect axial translation of the spindle portion 91 within the sleeve bearing 88. To facilitate engaging the handle portion 92, the spindle portion 91 may be at least partially rotated within the sleeve bearing 88 to orient the handle portion 92 in the position desired.

In any event, with the spindle portion 91 raised so as not to engage the head portion 60 on one of the bayonet lugs 56B the quick connect coupling 48 may be readily engaged with, or disengaged from, the drive head 46 on shaft 24, and the attaching frame 65 may be appropriately rotated to move the bayonet hooks 80 into engagement with, or disengagement from, the bayonet lugs 56, all without requiring that the operator's hand(s) be placed in jeopardy relative to the moving parts of the mixing unit 10 or that any tools be employed to effect the connection and/or disconnection.

It should now be apparent that a fluid mixing unit embodying the concepts of the present invention facilitates agitating, mixing and/or blending of fluids held in a container by permitting the impeller module to be relatively permanently affixed to the container, by providing an interconnecting arrangement which expedites demountably securing the power module to the impeller module and by otherwise accomplishing the objects of the invention.

I claim:

1. In combination with a container for fluid, a fluid mixing unit, said combination comprising:

an impeller module including a housing member, an impeller shaft rotatably mounted within said housing member, and at least one impeller affixed to said impeller shaft and disposed interiorly of said container for rotation with said impeller shaft;

means to affix said impeller module relatively permanently to said container;

bayonet lugs being secured to and extending outwardly from said housing member;

a power module including an attaching frame to which a power source may be secured;

a drive shaft extending from said power source;

a quick connect coupling secured to said drive shaft for operatively engaging said impeller shaft;

bayonet hooks presented from said attaching frame selectively to engage said bayonet lugs on said housing member;

locking means to prevent inadvertent disengagement of said bayonet hooks from said bayonet lugs;

a lid removably secured to said container;

a mounting flange extending transversely of said impeller module to underlie a portion of said lid;

an anchor plate overlying a portion of said lid and disposed to register with said mounting flange; and fastener means to secure said anchor plate to said mounting flange and sandwich said lid therebetween.

2. A combination, as set forth in claim 1, wherein:

a guide is presented from said anchor plate to assist in effecting an operative connection between said quick connect coupling on said drive shaft and said impeller shaft.

3. A combination, as set forth in claim 2, wherein:

thread means are provided interiorly of said guide; and, a plug is demountably secured to the threads in said guide when said power module is removed from said impeller module.

* * * * *